US009067250B2

(12) United States Patent
Halsey et al.

(10) Patent No.: US 9,067,250 B2
(45) Date of Patent: Jun. 30, 2015

(54) PORTABLE TUBE COILER

(71) Applicant: Solar Turbines Incorporated, San Diego, CA (US)

(72) Inventors: Byron William Halsey, La Mesa, CA (US); Ronald Kevin Johnston, El Cajon, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 13/722,467

(22) Filed: Dec. 20, 2012

(65) Prior Publication Data

US 2014/0175208 A1 Jun. 26, 2014

(51) Int. Cl.
*B65H 75/48* (2006.01)
*B21C 47/04* (2006.01)

(52) U.S. Cl.
CPC ..... *B21C 47/045* (2013.01)

(58) Field of Classification Search
USPC ..... 242/390, 390.1, 390.5, 390.6, 390.8, 242/390.9
See application file for complete search history.

(56) References Cited

U.S. PATENT DOCUMENTS

| | | | | | |
|---|---|---|---|---|---|
| 1,913,508 | A | * | 6/1933 | Phillips | 242/587.1 |
| 2,321,646 | A | * | 6/1943 | Blodgett | 242/362.1 |
| 2,329,943 | A | * | 9/1943 | Robins | 242/587.1 |
| 3,768,751 | A | * | 10/1973 | Brown | 242/483.3 |
| 3,784,125 | A | * | 1/1974 | Law et al. | 242/387 |
| 3,822,839 | A | * | 7/1974 | Persichini | 242/390.8 |
| 4,179,773 | A | * | 12/1979 | Savageau | 19/159 A |
| 4,186,881 | A | * | 2/1980 | Long | 239/198 |
| 4,454,999 | A | * | 6/1984 | Woodruff | 242/388.7 |
| 4,481,063 | A | * | 11/1984 | Morton | 156/349 |
| 4,588,142 | A | * | 5/1986 | Malzacher | 242/390.5 |
| 4,726,564 | A | * | 2/1988 | Lynn | 254/134.4 |
| 4,871,131 | A | * | 10/1989 | Bernier et al. | 244/122 AG |
| 4,887,777 | A | * | 12/1989 | Rasmussen | 242/390.8 |
| 5,228,484 | A | * | 7/1993 | Johnson | 141/65 |
| 5,277,350 | A | * | 1/1994 | Thornbury, Jr. | 244/155 A |
| 5,483,730 | A | * | 1/1996 | Hoover | 28/289 |
| 5,511,742 | A | * | 4/1996 | DeMasters | 242/470 |
| 5,695,150 | A | * | 12/1997 | Chevet et al. | 242/533.6 |
| 5,709,350 | A | * | 1/1998 | Davis et al. | 242/390.8 |
| 5,826,812 | A | * | 10/1998 | Hand | 242/363 |
| 5,904,313 | A | * | 5/1999 | Perret et al. | 242/533.6 |
| 6,178,992 | B1 | * | 1/2001 | Van Der Paal | 137/355.2 |
| 6,182,716 | B1 | * | 2/2001 | Fry | 141/67 |
| 6,273,357 | B1 | * | 8/2001 | Figge et al. | 242/533.4 |

(Continued)

FOREIGN PATENT DOCUMENTS

| | | | |
|---|---|---|---|
| CN | 201144126 | Y | 11/2008 |
| CN | 201694698 | U | 1/2011 |

(Continued)

*Primary Examiner* — Emmanuel M Marcelo
*Assistant Examiner* — Michael Gallion
(74) *Attorney, Agent, or Firm* — Procopio, Cory, Hargreaves & Savitch LLP

(57) ABSTRACT

A portable tube coiler and method for coiling. The portable tube coiler includes a spool assembly having a rotation axis and including a spool configured to rotate about the rotation axis (819), a tube receiver configured to rotate with the spool, a motor coupled to the spool assembly (810), and configured to rotate the spool, an anchor fixed to the motor and configured to provide a counter-rotation force to the motor, a power supply interface configured to transmit power to the motor, and a trigger configured to initiate rotation of the spool.

18 Claims, 3 Drawing Sheets

(56) References Cited

U.S. PATENT DOCUMENTS

| | | | | |
|---|---|---|---|---|
| 6,550,712 | B1 * | 4/2003 | Peterpaul | 242/390.8 |
| 6,569,084 | B1 * | 5/2003 | Mizuno et al. | 600/102 |
| 7,121,495 | B2 * | 10/2006 | Caamano | 242/390.5 |
| 2003/0094534 | A1 * | 5/2003 | Fujii et al. | 242/390.9 |
| 2006/0011765 | A1 * | 1/2006 | Dion | 242/397.3 |
| 2010/0101293 | A1 * | 4/2010 | Hoen | 72/202 |
| 2010/0307496 | A1 * | 12/2010 | Lueckenhoff | 128/204.18 |
| 2011/0180667 | A1 * | 7/2011 | O'Brien et al. | 244/135 R |
| 2013/0334479 | A1 * | 12/2013 | Yoder | 254/266 |
| 2014/0061354 | A1 * | 3/2014 | Wu | 242/390 |

FOREIGN PATENT DOCUMENTS

| | | | |
|---|---|---|---|
| CN | 102530607 | A | 7/2012 |
| CN | 202337851 | U | 7/2012 |

* cited by examiner

PORTABLE TUBE COILER

TECHNICAL FIELD

The present disclosure generally pertains to a tube coiling tool, and is more particularly directed toward a powered, portable tube coiler.

BACKGROUND

Thermocouple probes may be used to measure temperature in various regions of a gas turbine engine. Various thermocouple probes may be distributed throughout the gas turbine and meet at a single location, such as a junction box. Due to the harsh working environment, the thermocouple probes may include a sheath made of stainless steel or a superalloy, such as INCONEL to protect the thermocouple wires within. The thermocouple probes may be generally rigid and long, having outer diameters on the order of 3/16" (0.48 cm), and extending lengths such as 8'-15' (2.4 m-4.6 m). Thermocouple probes may be manufactured having a connector plug at the opposite end of its tip.

Chinese. Pat. No. CN202337851U issued Jul. 18, 2012 shows a spiral curve pipe ring strip device. In particular, the disclosure of CN202337851U is directed toward providing a spiral curve pipe coil device. The device includes a can coiler device for a spiral curve pipe. The device comprises a bearing seat and a coiling disc, wherein the end surface of the coiling disc is in rigid connection with one end of the bearing seat directly; and one port of the curve pipe penetrates through the coiling disc and is fixedly connected with one end surface of the coiling disc, and the other port of the curve pipe penetrates through an inner cavity of the bearing seat and is connected with a port at the other end of the bearing seat in a sealing mode. By the device, the bearing seat is in rigid connection with the coiling disc directly, and the spiral curve pipe has an integrated structure; and the device has an obvious using effect, is high in efficiency, improves the quality of the spiral curve pipe, can be stably operated, improves the efficiency of a combing machine and lays a basis for improvement on the quality of a yarn count.

The present disclosure is directed toward overcoming known problems and/or problems discovered by the inventors.

SUMMARY OF THE DISCLOSURE

A portable tube coiler is disclosed herein. The portable tube coiler includes a spool assembly having a rotation axis and including a spool configured to rotate about the rotation axis (819), a tube receiver configured to rotate with the spool, a motor coupled to the spool assembly (810), and configured to rotate the spool, an anchor fixed to the motor and configured to provide a counter-rotation force to the motor, a power supply interface configured to transmit power to the motor, and a trigger configured to initiate rotation of the spool. According to one embodiment, method for coiling metal tubing is also disclosed herein. The method for coiling metal tubing includes pneumatically coupling a pressurized air supply to a portable tube coiler, securing the metal tubing to the portable tube coiler, engaging an anchor of the portable tube coiler with an operator, and activating a trigger, the trigger configured to begin operation of a pneumatic motor of the portable tube coiler.

DETAILED DESCRIPTION

The present disclosure provides an automatic hand-held tool to coil elongated materials such as rigid metal tubing. The portable tube coiler is a tool that can be used to coil excess tubing of thermocouple probes installed in industrial gas turbine engine packages. The tool can turn at a slow rate while maintaining a high torque level. The tool can also hold the end of the thermocouple probe's tubing, and turn at a variable speed in both directions. The tool can be lightweight, quiet in operation, and ergonomically friendly so it can be used inside the gas turbine engine package, in the factory, or in the field.

Figure 1:
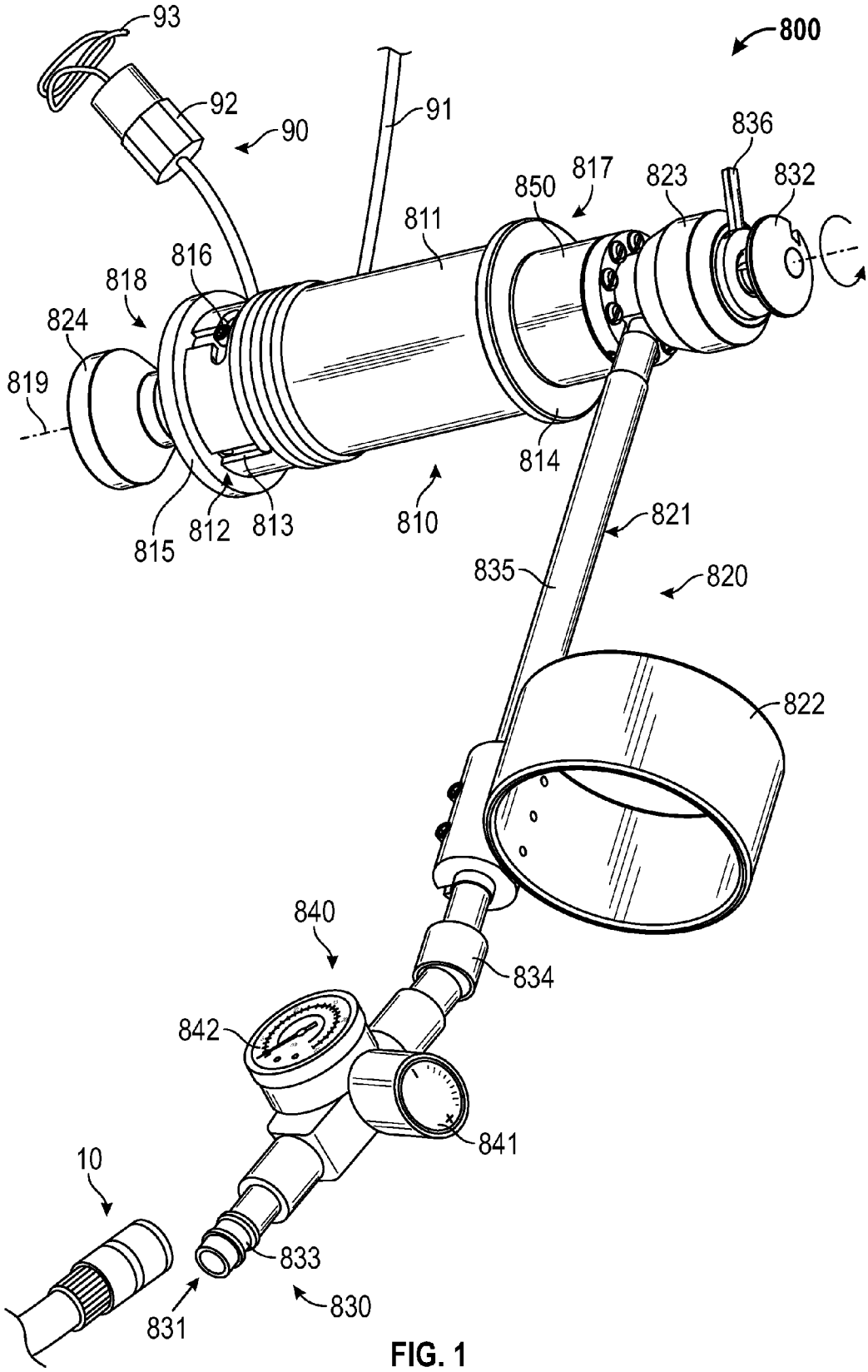
FIG. 1 is an isometric view of an exemplary portable tube coiler.

FIG. 1 is an isometric view of an exemplary portable tube coiler. In particular, the portable tube coiler 800 is shown as an air-powered, hand-held tube coiler. In addition, the portable tube coiler 800 is illustrated along with a partially coiled thermocouple probe 90. The thermocouple probe 90 is made up of a metal tube 91 and an end connector 92. The tube 91 forms a sheath around the thermocouple wiring 93. The thermocouple probe 90 is shown installed, for example in a gas turbine engine, with excess tubing being coiled up. The portable tube coiler 800 is also shown pneumatically de-coupled from its power supply, here, an air supply 10.

As illustrated, the portable tube coiler 800 includes a spool assembly 810, a tube receiver 812, an anchor 820, a power supply interface 830, a trigger 832, and a motor 850. Generally, the portable tube coiler 800 is configured to receive the tube 91 in the tube receiver 812, and coil the tube 91 about the spool assembly 810 using the motor 850. The motor 850 is powered by a power supply via the power supply interface 830, and is configured to drive the spool 811, when initiated by the trigger 832. The motor 850 receives its reactive counter-rotation force from the anchor 820, which may be braced against an operator. Here, motor 850 is a pneumatic motor, and accordingly, the supporting components are illustrated as pneumatic components.

The spool assembly 810 includes a spool 811, which has a rotation axis 819. For convenience, one end of the spool assembly 810 may be referred to as the anchor end 817, and the opposite end (along to the rotation axis 819) may be referred to as the outer end 818. The spool 811 is configured to rotate about the rotation axis 819, while coiling the tube 91 received in the tube receiver 812 between the anchor end 817 and the outer end 818.

According to one embodiment, the spool 811 may be shaped as a hollow cylinder having a circumferential wall. In particular, the spool 811 may be selected or sized based on the properties of the tube 91 to be coiled. For example, the spool 811 may have an outer diameter ("OD") of approximately 2" (5.1 cm), and a length of approximately 8" (20.3 cm). Also for example, the spool 811 may have an OD between 2"-4" (5.1 cm-10.2 cm), and a length between 6"-10" (15.2 cm-25.4 cm). Also for example, the spool 811 may be made of strong but light material such as 6061 aluminum alloy. Moreover, the spool 811 may form an enclosure for all or part of one or more components discussed herein.

The spool assembly 810 may further include an end bushing 814 and an end cap 815. The end bushing 814 and the end cap 815 are located at opposite sides of the spool 811. For example, the end bushing 814 may be located at the anchor end 817, and the end cap 815 at the outer end 818. Also, the end bushing 814 and the end cap 815 may include circumferential lips extending radially outward from the spool 811. Accordingly, being at opposite ends of the spool 811, the OD of the end bushing 814 and the end cap 815, and/or their respective circumferential lips, may be sized so as to limit travel of the coiled metal tube 91 beyond the ends of the spool 811.

Figure 2:
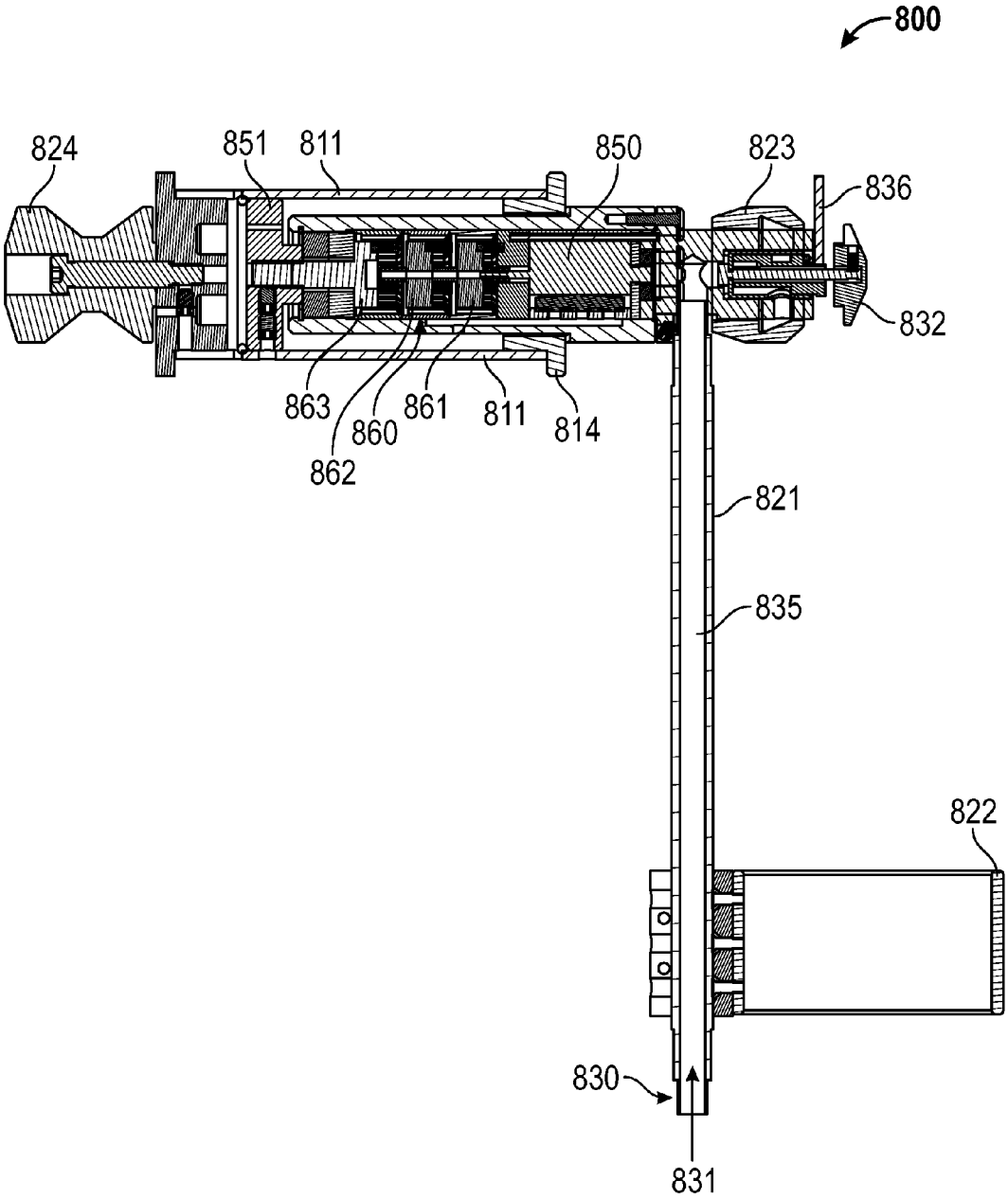
FIG. 2 is a partially cut away side view of the portable tube coiler of FIG. 1.

The end bushing 814 may be inserted in one end of the spool 811 and provides a bearing surface for the spool 811 (FIG. 2). In addition, the end bushing 814 may be fixed to the anchor 820, and be non-rotational. Conversely, the end cap 815 may be coupled to the spool 811 and configured to transmit a driving force from the motor 850 to the spool 811. Or, where the motor 850 is coupled to the spool 811 elsewhere, the end cap 815 may merely attach to the spool 811 as a rider, or may be unattached and configured to provide a second bearing surface to the spool 811.

According to one embodiment, the end cap 815 may be readily removable. In particular, the end cap 815 may include a quick release feature. In addition, the end cap 815 may be configured such that its removal exposes the spool 811 and provides for the removal of a completed coiled tube 91. In addition, removal of the end cap 815 may provide for insertion of the tube 91 into the tube receiver 812.

According to one embodiment, the spool assembly 810 may further include an end cap lock 816. In particular, the end cap lock 816 may be a quick-release mechanism for the end cap 815. The end cap lock 816 secures the end cap 815 in place, for example, during operation, but also provides for a ready release of the end cap 815 as needed. According to one embodiment, the end cap lock 816 may include a pin or other radial extension from the end cap 815 and a mating slot on the spool 811. For example, as illustrated, the mating slot may be a "T"-shaped slot (bidirectional rotation), or "L"-shaped slot (unidirectional rotation) on the spool 811. The end cap lock 816 may include spring loaded features as well. Alternately, the end cap lock 816 may be of any conventional quick-release configuration.

The tube receiver 812 is a locking feature configured to secure the tube 91 in place during rotation of the spool 811. In particular, the tube receiver 812 fixes a free end of the tube 91 to the spool 811 during rotation, so that the tube 91 may be held taut and cause the tube 91 to coil around the spool 811 as the spool 811 rotates about the rotation axis 819. According to one embodiment, where the tube 91 is sufficiently free or unable to be held taut in the tool, the tube receiver 812 may further include a guide configured to confine the entering uncoiled portion of tube 91 along a tangent line of the spool 811. The tube receiver 812 may be an independent component, may be integrated into another component, or may be a combination of more than one component of the portable tube coiler 800.

According to one embodiment, the tube receiver 812 may be a component combination, including an axial slot 813 in a first component, and a reciprocal covering portion of a second component. In particular, the tube 91 can slide into the axial slot 813 in an axial direction when the covering portion of the second component is removed, and then the tube 91 can be secured in the axial slot 813 when the covering portion of the second component is replaced and terminates the opening of the axial slot 813. For example, the tube receiver 812 may include an axial slot 813 through the spool 811, and a reciprocal covering portion of the end cap 815, or vis versa.

According to one embodiment, the spool 811 is configured to allow the tube 91 to slide in the axial direction into the axial slot 813 in the spool 811 when the end cap 815 is removed; and the end cap 815 is configured to close off the axial slot 813 when the end cap 815 is locked onto the spool 811. In particular, the axial slot 813 may begin at the outer end 818 of the spool 811, and axially travel toward the anchor end 817 of the spool 811, intersecting the circumferential wall of the spool 811 at two locations. Moreover, the axial slot 813 includes a corresponding passageway through the interior of the spool 811. The axial slot 813 may run along a diameter of the spool 811 (i.e., intersecting the rotation axis 819) or may run along a chord of the spool 811 (i.e., off-center, or not intersecting the rotation axis 819). Additionally, the axial slot 813 may be a minimum of one tube diameter in circumferential width, and at least one tube diameter in axial length. The end cap 815 then interfaces with the spool 811 such that at least a portion of the axial slot 813 is closed off when the end cap 815 is locked on.

The anchor 820 is fixed to the motor 850 and is configured to provide a counter-rotation force to the motor 850. The anchor 820 includes an anchor arm 821 and an anchor brace 822. In particular, the anchor arm 821 is a mechanical arm fixed to the motor 850 and extends away from the rotation axis 819. In addition, the anchor brace 822 may be any convent interface to a mechanical ground. The anchor arm 821 is also fixed to the anchor brace 822. Alternately, the anchor arm 821 may be integrated with the anchor brace 822, forming features of a single member.

According to one embodiment, the anchor 820 may be an operator anchor, where the anchor brace 822 is grounded against an operator. In particular, the anchor brace 822 may be grounded against at least one arm of the operator. For example, the anchor brace 822 may include a hoop configured to receive an operator's hand and rest on his forearm. The hoop may be oversized to provide additional comfort and ease of use. Alternately, anchor brace 822 may include an open interface having two forearm receivers (e.g., a "C" shape configured to land on both the upper and lower forearm), such that the anchor brace 822 is configured to apply a force against an upper side of an arm of the operator during use and regardless of whether the anchor brace 822 is grounded against the left or right arm.

According to one embodiment, the anchor arm 821 forms a moment arm reducing reaction force needed to provide the counter-rotation force to the motor 850. In particular, the anchor arm 821 may be of sufficient radial length, independent of path taken, to provide the counter-rotation force with a predetermined opposing force at the anchor brace 822. For example the anchor arm 821 may extend at least 9 inches in a radial direction from the rotation axis. Alternately, the anchor arm may extend such that the anchor brace 822 is at least 9 inches in a radial direction from the rotation axis.

According to one embodiment, the anchor arm 821 may include a power conduit coupled to the motor 850. In particular, anchor arm 821 may be coupled to both the motor 850 and the power supply interface 830 and configured to transmit power therebetween along a power supply path 831. For example, the anchor arm 821 may include a pressurized air conduit 835 pneumatically coupled to both the motor 850 and to the power supply interface 830 (FIG. 2). The pressurized air conduit 835 may be formed from a hollow passageway through the anchor arm 821. Alternately, the pressurized air conduit 835 may be a separate passageway (not shown), fixed to the anchor arm 821. Additionally, the anchor arm 821 may extend beyond the anchor brace 822, providing clearance for the power supply interface 830, and well as any other intermediate features or components along the power supply path 831.

The anchor 820 may further include an anchor handle 823 and/or an outer handle 824. The anchor handle 823 and the outer handle 824 may be of and convenient shape and are generally located on the anchor end 817 and the outer end 818, respectively. The anchor handle 823 may be proximate the trigger 832. The outer handle 824 may be at the opposite end of the spool 811 and integrated into the end cap 815.

The power supply interface 830 receives power to power the motor. Here, the power supply interface 830 includes a pneumatic coupling plug 833 configured to interface with a pressurized air supply and transmit compressed air via the power supply path 831 to power the motor 850. The power supply interface 830 may include a standardized pneumatic coupler plug and/or any convenient fitting configured to interface with the air supply 10 provided. For example, the power supply interface 830 may also include a swivel coupling 834 or fitting configured to permit an air supply hose swivel and angle away from the operator when the portable tube coiler 800 is in use. The swivel coupling 834 may be pneumatically located along the power supply path 831.

The portable tube coiler 800 may also include an air regulator 840. In particular, the air regulator 840 may be configured to vary power transmitted to the motor 850, serving as motor control. For example the air regulator 840 may present a valve or variable orifice in pneumatically in the power supply path 831 and having a range of full open to full closed. In this way an operator may control the air flow through the power supply path 831. The air regulator 840 may be pneumatically located anywhere along the power supply path 831, upstream of the motor 850. For example, as illustrated, the air regulator 840 may be pneumatically located the power supply path 831, between the swivel coupling 834 attached to the anchor arm 821 and a pneumatic coupling plug 833.

The air regulator 840 may include a user interface 841 and a display 842. The user interface 841 may be a manual control, such as a rotary knob configured to set the regulator (e.g., a valve position control). The display 842 may be any convenient representation of the status of the air regulator 840 and/or the compressed air transmitted to the motor 850. For example, the display 842 may be a 0-150 psi (0-1034 kPa) analog pressure gage, registering line pressure in the power supply path 831. Alternately, the display 842 may be digital. The display 842 may register pressure upstream and/or downstream of the air regulator 840. Alternately, the display 842 may configured to represent a value associated with the output of the portable tube coiler 800, such as the speed, direction, and/or torque of the spool 811.

FIG. 2 is a partially cut away side view of the portable tube coiler of FIG. 1. In particular, the internal drive train of the portable tube coiler 800 is illustrated. Also, the portable tube coiler 800 is shown without its pneumatic components upstream of the anchor arm 821.

As discussed above the portable tube coiler 800 includes a trigger 832, and a motor 850. The trigger 832 is configured to initiate rotation of the spool 811. The may be any convenient user interface that opens the power supply path 831 to the motor 850, causing it to operate. For example, here the trigger 832 embodied as an axial button engaging the motor upon depression in an axial direction, relative to the rotation axis and toward the outer end 818. In particular, upon depression, the axial button unblocks the power supply path 831, completing the pneumatic circuit with the motor 850. Moreover, as illustrated, the trigger 832 may be coordinated with the anchor handle 823 such that it is configured to be palm-activated. In addition, the trigger 832 may be biased in a "normally-off" position such that the power supply path 831 can only have flow when trigger 832 is engaged.

As discussed above, the motor 850 may be a pneumatic motor. In particular, the motor 850 may a rotary air motor configured to operate on available "shop air" or a variant thereof. For example, the motor 850 may operate on air pressure of at least 45 psi (310 kPa). Alternately, the motor 850 may operate on air pressure of over 80 psi (552 kPa). Alternately, the motor 850 may operate on air pressure of at least 45-90 psi (310-621 kPa). Alternately, the motor 850 may operate on air pressure of at least 80-120 psi (552-621 kPa). In addition, the motor 850 may have a maximum output shaft speed of 10 k RPM (167 Hz). Also, with the motor 850 configured as a pneumatic motor, the portable tube coiler 800 may weigh less than 5 lbs (2.27 kg).

According to one embodiment, the portable tube coiler 800 may be reversible. In particular the motor 850 may operate in both a forward and a reverse direction, and the portable tube coiler 800 may include a spool rotation selector 836. For example, the spool rotation selector 836 may select a flow inlet for the motor 850, or may otherwise determine the rotation direction of the spool 811. Accordingly, a first selection may configure the portable tube coiler 800 for the spool 811 to rotate about the rotation axis 819 in a first direction, and a second selection may configure the portable tube coiler 800 for the spool 811 to rotate about the rotation axis 819 in a second direction opposite the first direction.

The spool rotation selector 836 may be a lever or any convenient user interface for selection. In one embodiment, the spool rotation selector 836 may be located at the anchor end 817 proximate the trigger 832 and the anchor handle 823, and be configured such that an operator may select the rotation direction of the spool 811 with the same hand holding the anchor handle 823. The spool rotation selector 836 may be locked in place when the motor 850 is engaged.

According to one embodiment, the portable tube coiler 800 may include an air muffler 851. In particular, the air muffler 851 may reduce noise emitted by the motor 850, such as from air exhaust. For example, the air muffler 851 may include one or more baffle plates placed in the air exhaust stream, sealed within the spool 811. Also for example, the air muffler 851 may be a circumferentially perforated annular disk tuned to the exhaust characteristics of the motor 850. The air muffler 851 may be configured to suppress or otherwise limit noise from the motor 850 to 80 dB or less.

The portable tube coiler 800 may further include a reduction gear 860. The reduction gear 860 reduces the output speed of the motor 850 (e.g., output shaft speed), while increasing the available torque on the spool 811. For example the reduction gear 860 may be configured to reduce the maximum output speed of the motor 850 under load to 70 RPM (1.17 Hz). Also for example the reduction gear 860 may be configured to reduce the maximum output speed of the motor 850 under load to 100 RPM (1.67 Hz). Furthermore, the reduction gear 860 may be configured such that the spool 811 may provide 170 in.-lbs (19.2 Nm) of torque during operation. Alternately, the reduction gear 860 may be configured such that the spool 811 may provide 69-156 in.-lbs (7.8-17.6 Nm) of torque during operation. Also for example the reduction gear 860 may be configured such that, during operation, the spool 811 rotates between 0-100 RPM (0-1.67 Hz) while providing up to 200 in.-lbs (22.6 Nm) of torque. Alternately, portable tube coiler 800 may be configured to rotate the spool 811 at a speed between 0-70 RPM (0-1.17 Hz) with a torque of 50-170 in.-lbs (5.6-19.2 Nm).

According to one embodiment, all or part of the reduction gear 860 may be housed all or partially within the spool assembly 810. As discussed above, the motor 850 may have a maximum output shaft speed of 10 k RPM (167 Hz). As such, the reduction gear 860 may include a gear train of multiple reduction gear stages. For example, as illustrated, the reduction gear 860 may include a first reduction gear stage 861, a second reduction gear stage 862, and a third reduction gear stage 863, each having approximately a 10:1 ratio, and geared together in series.

INDUSTRIAL APPLICABILITY

The present disclosure generally applies to a portable tube coiler for coiling excess tubing of INCONEL thermocouple probes in industrial gas turbine engines. The described embodiments are not limited, however, to use in conjunction with a particular type of tube or gas turbine engine. The portable tube coiler may be suited for any number of industrial applications, such as, but not limited to coiling tubing, rods, wire, of any ductile material. In addition, the portable tube coiler may be used in any application, machine, and/or industry that would require coiling of tubing and the like.

In some instances, embodiments of the presently disclosed portable tube coiler are applicable to the use, operation, maintenance, repair, and improvement of gas turbine engines, and may be used in order to improve performance and efficiency, decrease maintenance and repair, and/or lower costs. In addition, embodiments of the presently disclosed portable tube coiler may be applicable at any stage of the gas turbine engine's life, from design to prototyping and first manufacture, and onward to end of life. Accordingly, the portable tube coiler may be used in conjunction with a retrofit or enhancement to existing gas turbine engine, as a preventative measure, or even in response to an event.

Moreover, the presently disclosed portable tube coiler may provide for increased productivity, performance, and comfort. In particular, manual coiling of an INCONEL thermocouple tube may take on the order of 15-20 min. per tube. In addition, each coil may vary from technician to technician or even through the progression of a work day. In contrast, using the presently disclosed portable tube coiler the same tubes may be coiled in 30-40 seconds. The two handle embodiment also provides for an operator to more tightly wind the coil by tilting the rotation axis such that it provides angular component in the coil compression direction, and vis versa.

Also, where coiling takes place in the field, such as on a gas turbine engine that is already installed in a gas turbine engine package, space may be limited. Manual coiling may be required at inconvenient angles or hard to reach locations. In contrast, the disclosed portable tube coiler is lightweight, fast, and easy to handle. For example, as discussed above, the anchor arm reduces the force needed to bend the tube. Also for example, the anchor brace frees up the operators hands, secures the portable tube coiler to the operator, and may be ambidextrous.

In addition, while the disclosed portable tube coiler may use different types of motors, the pneumatic motor configuration provides certain benefits. In particular, the pneumatic motor configuration is generally lighter than with an electric motor. Also, the pneumatic motor configuration may run cooler and live longer under some of the demanding torque, speed, and weight requirements described herein. In addition to imparting the high torques needed to bend rigid materials, the reduction gears provide for a reduced spool speed that gives greater operator control. In particular, coiling the tube draws the spool inward toward the installed end of the tube; by slowing the spool speed, the operator is not drawn in too fast. Furthermore, the disclosed portable tube coiler may be made using one or more preexisting components (e.g., pneumatic motors, reduction gears, etc) found in commercially available pneumatic drills, for example.

Figure 3:
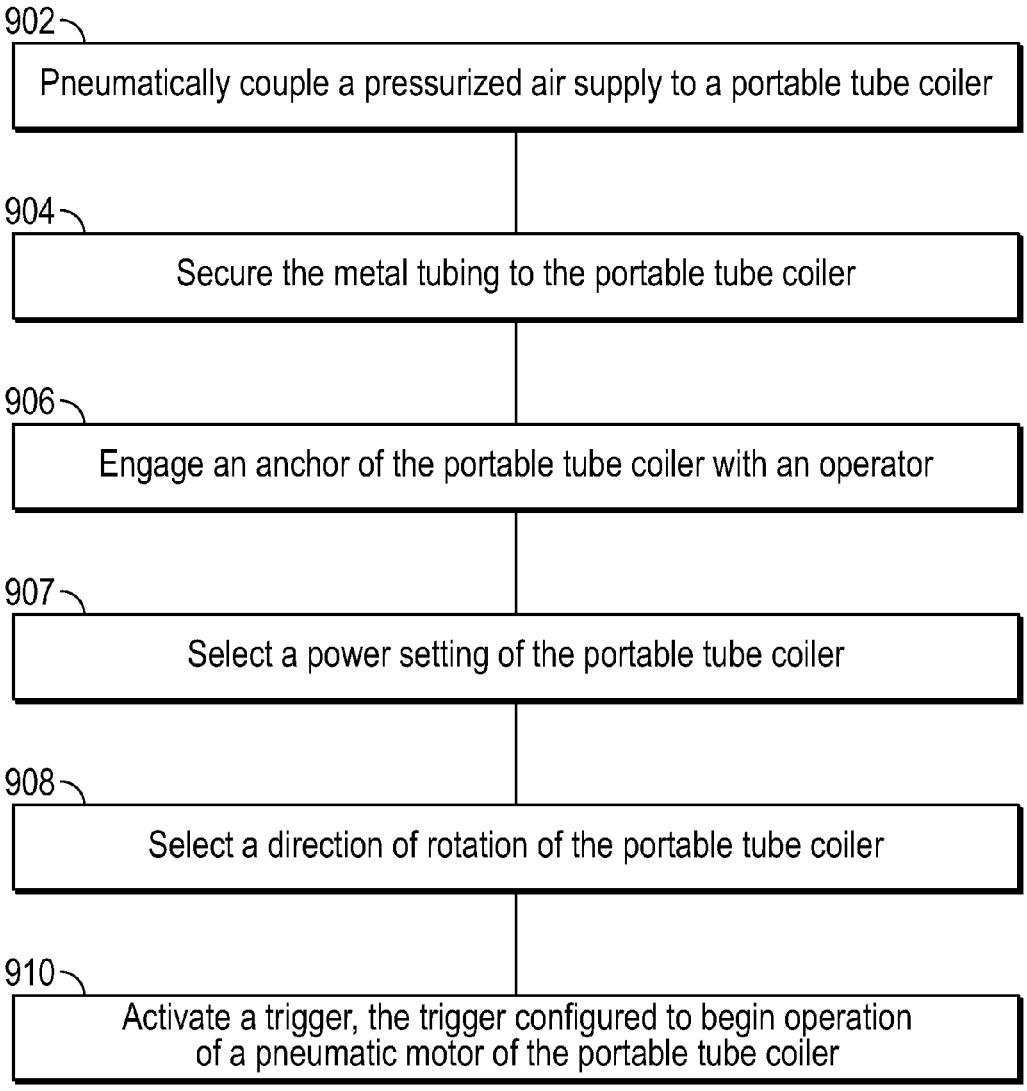
FIG. 3 is a flow chart of an exemplary method for coiling metal tubing.

FIG. 3 is a flow chart of an exemplary method for coiling metal tubing. In particular, metal tubing, and or tubing, rods, wire, etc. of any ductile material may be bent or coiled using the following method, the above description, or a combination thereof. As illustrated (and with reference to FIG. 1 and FIG. 2), the tube 91 may be bent or coiled by operating the disclosed portable tube coiler.

The method begins with setting up the portable tube coiler. In particular, the method includes pneumatically coupling a pressurized air supply to the portable tube coiler 902, securing the metal tubing to the portable tube coiler 904, and engaging an anchor of the portable tube coiler with an operator 906. Pneumatically coupling a pressurized air supply to the portable tube coiler 902 may include coupling "shop air" to a pneumatic coupling plug of the portable tube coiler, for example. Where other motors are used, the appropriate power supply may be coupled to the portable tube coiler via its power supply interface.

As discussed above, securing the metal tubing to the portable tube coiler 904 may include disengaging an end cap lock, removing an end cap, installing the tube in a tube receiver and locking the end cap back on. Depending on the application and/or the configuration of the portable tube coiler, securing the metal tubing to the portable tube coiler 904 may include a more, less, or different steps in securing the metal tubing. For example, according to one embodiment, the tube may be manually given an initial bend against the spool as part of securing it.

Engaging the anchor of the portable tube coiler with the operator 906 may include bracing the anchor against an arm of the operator. In particular, the operator may engage either arm with an anchor brace. For example, the operator may engage his forearm with an anchor brace of the portable tube coiler such that, during operation of the portable tube coiler will apply a reaction force to an upper portion of the forearm. Also for example, the operator may hold on to an anchor handle and/or an outer handle of the portable tube coiler as part of engaging the anchor.

The method may further include selecting a power setting of the portable tube coiler 907. The setting may be set by adjusting the pressure of the air supply to the portable tube coiler. For example, an air regulator user interface of portable tube coiler may be adjusted as desired. Moreover, the power setting may be set before, during, and after operation of the portable tube coiler.

The method may further include selecting a direction of rotation of the portable tube coiler 908. The direction of rotation may be set by engaging a spool rotation selector of the portable tube coiler. For example, the spool rotation selector may be set before, during, and after operation of the portable tube coiler. Alternately, the spool rotation selector may be set before operation and locked or disengaged until operation is complete.

The method further includes operating the portable tube coiler. In particular, the method includes activating a trigger, the trigger configured to begin operation of a pneumatic motor of the portable tube coiler 910. As discussed above, operation of the pneumatic motor will rotate the spool, coiling the secured tube about its rotation axis. According to one embodiment, the operator may tilt the rotation axis during operation such that it provides angular component in the coil compression direction. In this way, operating the portable tube coiler may include coiling the tubing with a desired coil spacing The disclosed portable tube coiler and method for coiling metal tubing may be used as part of a method of installing fixed length thermocouple probes at various distances in a gas turbine engine from a common junction or coupling interface. For example, fixed length INCONEL thermocouple probes are needed at multiple locations inside the gas turbine engine package (or enclosure); the left over tube length is then coiled to be out of the way. However, the tubing is rigid and hard to coil, especially in tight places like inside the enclosure of the gas turbine engine package. Moreover, the tubing from the end of the thermocouple probe to where the wires were terminated might be in excess of 12 feet long, making it difficult to coil this length of tubing because the INCONEL is very hard and rigid. The disclosed portable tube coiler may be small enough to enter and be used within the gas turbine engine package, which may vary in size and shape from one gas turbine engine package to another.

The preceding detailed description is merely exemplary in nature and is not intended to limit the invention or the application and uses of the invention. The described embodiments are not limited to use in conjunction with a particular type of coiled materials. Hence, although the present embodiments are, for convenience of explanation, depicted and described as being implemented for coiling INCONEL thermocouple probes, it will be appreciated that it can be implemented for coiling various elongated members, and for coiling various materials. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A portable metal tube coiler comprising:

a spool assembly having a rotation axis, the spool assembly including a spool configured to rotate about the rotation axis, the spool having an axial slot beginning at an open outer end of the spool and terminating at a predetermined length along the spool, and the axial slot configured to receive an end of a metal tube, and a removable end cap releasably engaged in the outer end of the spool to lock the metal tube in the axial slot for coiling;

a pneumatic motor coupled to the spool assembly, the pneumatic motor configured to rotate the spool;

an operator anchor fixed to the pneumatic motor, the operator anchor configured to provide a counter-rotation force to the pneumatic motor and to be grounded against an operator, wherein the operator anchor includes an anchor handle extending from the pneumatic motor along the rotation axis, an anchor arm extending from the anchor handle in a direction non-parallel to the rotation axis, and an anchor brace attached to the anchor arm, the anchor brace located distal to the anchor handle, the anchor brace configured to transmit a reaction force from the pneumatic motor against an upper side of an arm of an operator, the anchor arm including a pressurized air conduit extending through the anchor arm, and the pressurized air conduit coupled to the pneumatic motor;

a pneumatic power supply interface configured to transmit power to the pneumatic motor, the pneumatic power supply interface pneumatically coupled to the pressurized air conduit; and a trigger coupled to the anchor handle and configured to initiate rotation of the spool.

2. The portable tube coiler of claim 1, wherein portable tube coiler is configured to rotate the spool at a speed between 0-70 RPM with a torque of 50-170 in.-lbs.

3. The portable tube coiler of claim 1, wherein pneumatic power supply interface includes a power supply path between an air supply and the pneumatic motor, the pneumatic power supply interface further including a swivel coupling pneumatically located along the power supply path.

4. The portable tube coiler of claim 1, further comprising an outer handle, the outer handle and the trigger on opposite ends of the spool; and wherein the trigger includes an axial button, the axial button engaging the pneumatic motor upon depression in an axial direction, relative to the rotation axis and toward the outer end.

5. The portable tube coiler of claim 1, wherein the anchor brace is located at least 9 inches from the anchor handle.

6. The portable tube coiler of claim 5, wherein the portable tube coiler weighs less than 5 lbs.

7. A portable tube coiler comprising:

a spool assembly having a rotation axis, the spool assembly including a spool configured to rotate about the rotation axis, the spool having an axial slot beginning at an open outer end of the spool and terminating at a predetermined length along the spool, and the axial slot configured to receive an end of a metal tube, and a removable end cap configured to releasably engage in the outer end of the spool to lock the metal tube in the axial slot for coiling;

a pneumatic motor coupled to the spool assembly, the pneumatic motor configured to rotate the spool;

an anchor fixed to the pneumatic motor, the anchor configured to provide a counter-rotation force to the pneumatic motor;

wherein the anchor includes an anchor handle extending from the pneumatic motor along the rotation axis, an anchor arm extending from the anchor handle in a direction non-parallel to the rotation axis, and an anchor brace attached to the anchor arm, the anchor brace located distal to the anchor handle, the anchor arm including a pressurized air conduit extending through the anchor arm, and the pressurized air conduit coupled to the pneumatic motor;

a pneumatic power supply interface configured to transmit power to the pneumatic motor, the pneumatic power supply interface pneumatically coupled to the pressurized air conduit; and a trigger coupled to the anchor handle and configured to initiate rotation of the spool.

8. The portable tube coiler of claim 7, wherein portable tube coiler is configured to rotate the spool at a speed between 0-70 RPM with a torque of 50-170 in.-lbs.

9. The portable tube coiler of claim 7, wherein the pneumatic power supply interface includes a pneumatic coupling plug.

10. The portable tube coiler of claim 9, further comprising an air muffler configured to suppress noise from the portable tube coiler to less than 80 dB.

11. The portable tube coiler of claim 9, further comprising an air regulator including a user interface and a display, the air regulator configured to vary power transmitted to the pneumatic motor.

12. The portable tube coiler of claim 7, further comprising a spool rotation selector, the spool rotation selector including a first selection that configures the portable tube coiler for the spool to rotate about the rotation axis in a first direction; and wherein the spool rotation selector further includes a second selection that configures the portable tube coiler for the spool to rotate about the rotation axis in a second direction opposite the first direction.

13. The portable tube coiler of claim 7, further comprising a reduction gear configured to reduce an output speed of the pneumatic motor, the reduction gear is housed at least partially within the spool assembly.

14. The portable tube coiler of claim 13, wherein the pneumatic motor has a maximum output speed; and wherein the reduction gear is further configured to reduce the maximum output speed to less than 100 RPM.

15. A method for coiling metal tubing, the method comprising:

pneumatically coupling a pressurized air supply to a portable tube coiler, the portable tube coiler including a spool configured to rotate about a rotation axis, the spool having axial slot beginning at an open outer end of the spool and terminating at a predetermined length along the spool;

securing the metal tubing to the portable tube coiler by inserting an end of the metal tubing into the axial slot, the axial slot at least partially closed off by a removable end cap;

engaging an anchor of the portable tube coiler with an operator, the anchor including an anchor handle extending from a pneumatic motor along the rotation axis, an anchor arm extending from the anchor handle in a direction non-parallel to the rotation axis, and an anchor brace attached to the anchor arm, the anchor brace located distal to the anchor handle, the anchor brace configured to transmit a reaction force from the pneumatic motor against an upper side of an arm of the operator, the anchor arm including a pressurized air conduit extending through the anchor arm, and the pressurized air conduit coupled to the pneumatic motor;

activating a trigger, the trigger configured to begin operation of the pneumatic motor of the portable tube coiler and forming a coiled portion of the metal tubing; and removing the formed coiled portion of the metal tubing from the portable tube coiler.

16. The method of claim 15, wherein one end of the metal tubing is installed in a gas turbine engine package.

17. The method of claim 15, further comprising:

selecting a power setting of the portable tube coiler; and selecting a direction of rotation of the portable tube coiler.

18. The method of claim 15, wherein the engaging the anchor of the portable tube coiler with the operator includes bracing the anchor against an arm of the operator.

* * * * *